US010777884B2

(12) United States Patent
Wilken et al.

(10) Patent No.: US 10,777,884 B2
(45) **Date of Patent: *Sep. 15, 2020**

(54) SELF-POINTING WI-FI ANTENNA

(71) Applicant: Electronic Controlled Systems, Inc., Bloomington, MN (US)

(72) Inventors: Scott Wilken, Eden Prairie, MN (US); Michael Bendzick, Falcon Heights, MN (US); Craig Miller, Eden Prairie, MN (US)

(73) Assignee: Electronic Controlled Systems, Inc., Bloomington, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/595,432

(22) Filed: Oct. 7, 2019

(65) Prior Publication Data

US 2020/0112090 A1 Apr. 9, 2020

Related U.S. Application Data

(63) Continuation of application No. 15/594,399, filed on May 12, 2017, now Pat. No. 10,439,279.

(60) Provisional application No. 62/335,651, filed on May 12, 2016.

(51) Int. Cl.

| | |
|---|---|
| ***H01Q 3/00*** | (2006.01) |
| ***H01Q 1/42*** | (2006.01) |
| ***H01Q 3/04*** | (2006.01) |
| ***H01Q 1/22*** | (2006.01) |
| ***H01Q 3/10*** | (2006.01) |

(52) U.S. Cl.
CPC ..... *H01Q 3/005* (2013.01); *H01Q 1/2291* (2013.01); *H01Q 1/42* (2013.01); *H01Q 3/04* (2013.01); *H01Q 3/10* (2013.01)

(58) Field of Classification Search
CPC ..... H01Q 3/005; H01Q 1/2291; H01Q 1/42; H01Q 3/10; H01Q 3/04
USPC ..... 343/757
See application file for complete search history.

(56) References Cited

U.S. PATENT DOCUMENTS

| | | | | |
|---|---|---|---|---|
| 7,359,362 | B2 * | 4/2008 | King | H04W 72/046 343/702 |
| 10,009,901 | B2 * | 6/2018 | Gerszberg | H04L 5/0048 |
| 10,051,483 | B2 * | 8/2018 | Barzegar | H01Q 19/08 |
| 10,469,156 | B1 * | 11/2019 | Barzegar | H04W 36/14 |
| 2007/0045018 | A1 * | 3/2007 | Carter | B60T 7/16 180/167 |
| 2013/0183935 | A1 * | 7/2013 | Holostov | H04W 36/22 455/411 |
| 2019/0306057 | A1 * | 10/2019 | Barzegar | H04B 3/52 |

* cited by examiner

*Primary Examiner* — Huedung X Mancuso
(74) *Attorney, Agent, or Firm* — Skaar Ulbrich Macari, P.A.

(57) ABSTRACT

A self-aiming directional Wi-Fi antenna system includes a directional antenna that is motorized. A motion controller operates the motors to move the antenna position to sources of Wi-Fi radio frequency (RF) transmissions, determines an SSID for each source that satisfies a selection criterion and stores a position data corresponding to each SSID. The directional Wi-Fi antenna is moved to a final position corresponding to the antenna position data for one of the SSIDs stored in memory.

20 Claims, 9 Drawing Sheets

SELF-POINTING WI-FI ANTENNA

PRIORITY

This application is a continuation of U.S. application Ser. No. 15/594,399, filed May 12, 2017, which claims the priority benefit of U.S. Provisional Application No. 62/335,651, filed on May 12, 2016, and both of which are hereby incorporated herein by reference in their entirety.

FIELD

The present invention relates generally to antenna systems for wireless voice and data networks, and more particularly, to a Wi-Fi antenna system that can perform a self-pointing procedure.

BACKGROUND

Both public and private wireless fidelity or ("Wi-Fi") networks intended to provide internet connectivity services to mobile users at locations such as truck stops and campgrounds often fail to provide adequate service due to a limited coverage area. In many cases, the Wi-Fi access point providing the connection is located fully inside a building, or obstructions such as trees, utility buildings, gas pumps, or other structures further reduce signal strength. Thus, by the time the signal arrives at the user located remotely on the property, the signal is considerably weakened and resulting throughput is reduced.

The reception antennas typically used by the remotely-located user are almost always of an omni-directional type, which sacrifice efficiency in a particular direction in exchange for some lesser efficiency in all directions. Further, such omni-directional antennas usually are mounted directly to a device that is located inside of the structure or vehicle instead of in the open air, e.g. on a rooftop, where the Wi-Fi signal would be best received.

A directional Wi-Fi antenna will improve the situation by allowing the user to connect a stronger signal to the input of their bridge, router, or other Wi-Fi-connected equipment. Although a directional antenna system requires the antenna to be pointed directly at the access point source signal to make a connection, the connection is stronger than what could otherwise be obtained with an omni-directional antenna.

Although directional Wi-Fi antennas are available for sale in the market, all require the user to aim them manually. This is impractical in the case of an antenna mounted on vehicles and mobile structures such as a truck, a recreational vehicle ("RV"), trailer, fish house, or similar, since the user would need to move outside to the antenna and manually perform an adjustment to find the strongest signal, not just from Wi-Fi generally, but from the particular Wi-Fi access point that user wants to connect to. Most often, this aiming procedure would require the user to climb onto a rooftop, unfasten the antenna hardware to turn the antenna, and have a way to measure signal strength from a particular Wi-Fi access point. The user would then need to repeatedly climb down from the mounting location to check signal readings and be prepared to repeat this time consuming aiming and checking procedure whenever the antenna and/or the mounting surface (usually, a vehicle) are moved.

Additionally, since Wi-Fi networks operate in the unlicensed Industrial, Scientific and Medical bands (or "ISM Band") frequency range of radio communications, there are many possible transmitter "sources" operating in this range and care must be taken to ensure that the specific named Wi-Fi network Service Set Identifiers (or "SSIDs") are considered. Thus, the user will need to ensure that their directional antenna is indeed oriented towards the specific Wi-Fi network that the user wishes to connect to.

Therefore there remains a need to provide an improved Wi-Fi antenna that addresses some or all of the drawbacks in the prior art.

SUMMARY

The present invention addresses certain deficiencies discussed above by providing a self-pointing Wi-Fi antenna system. A self-pointing directional antenna allows the user to mount the antenna external to the vehicle, or building, and have the system automatically point the Wi-Fi antenna at a desired Wi-Fi access point. The user can input into the system a specific SSID that the antenna will automatically aim at, or the user can be presented with a selectable menu of available SSIDs that the antenna system located during a searching procedure, or the antenna system can automatically find and lock onto a Wi-Fi access point meeting certain specified parameters (e.g., the strongest unsecured signal, the last locked-on SSID, or the strongest member of a class of SSIDs).

A self-pointing Wi-Fi antenna system in one disclosed embodiment includes a directional antenna that is motorized. A motion controller operates the motors to move the antenna position (or orientation) to aim at sources of Wi-Fi radio frequency (RF) transmissions and verify the correct network SSID is present as transmitters are found. An integral network interface includes a Wi-Fi chipset, or the equivalent in an integrated module, to identify the individual SSIDs present in the various target RF sources identified during an aiming procedure.

According to one disclosed method of operation, the system performs a scan of Wi-Fi radio frequencies as the antenna is moved in one or more axes. The system verifies that the potential targets are in the desired RF ranges and the SSID for each is checked to ensure that it is the SSID for the user's desired Wi-Fi network. The antenna position data with respect to the surface on which it is mounted is stored in memory for antenna positions corresponding to the desired network. The antenna is finally positioned where the highest radio frequency ("RF") power level, lowest bit error rate (or "BER"), or most generally the best signal quality was detected for the desired SSID. The user can input the desired SSID through a smart phone app that is wirelessly coupled to the antenna system.

In an alternative or additional embodiment, the antenna system presents a list or menu of all SSIDs that meet certain requirements (e.g. above a preset minimum signal strength). An orientation of the antenna is stored in memory corresponding to each SSID on the menu. The user chooses the desired SSID from the menu and the antenna returns to the corresponding orientation for the chosen SSID.

The disclosure includes a method of automatically aiming a directional Wi-Fi antenna system. The method includes actuating a motor to move a directional Wi-Fi antenna about at least one axis. RF signal targets are detected automatically while the directional Wi-Fi antenna is moving. Service Set Identifiers (SSIDs) are automatically determined for each RF signal target while the directional Wi-Fi antenna is moving. Antenna position data corresponding to each of the SSIDs that satisfy a selection criterion is automatically stored in memory. The directional Wi-Fi antenna is moved to a final position corresponding to the antenna position data for one of the SSIDs stored in memory.

A dynamic average RF energy value can be calculated by averaging an RF value for a plurality of detected RF signal targets (or for a subset thereof, such as only those that satisfy a selection criterion). All SSIDs that both satisfy the selection criterion and have RF energy values greater than the dynamic average energy value can be displayed on a screen of a user computing device.

RF energy values can be stored in memory corresponding to each of the SSIDs that satisfy a selection criterion, or set of selection criteria. RF energy values can also be stored in memory corresponding to each of the SSIDs that do not satisfy a selection criterion.

The selection criterion can include unsecured Wi-Fi targets. The selection criterion can also include all SSIDs possessing a particular partial SSID character string (or strings). The directional Wi-Fi antenna is moved to the final position corresponding to the antenna position data for the SSID stored in memory with the highest RF energy value.

The motor can be actuated to begin an aiming procedure automatically upon the Wi-Fi antenna system being powered ON, or in response to a user inputting a search command remotely.

The directional Wi-Fi antenna system can be synced to a user's computing device. A list of all SSIDs corresponding to RF signal targets that satisfy the selection criterion can be displayed on a screen of a computing device. The user can select via the computing device one SSID from the list of all SSIDs displayed on the screen, and the selected SSID becomes the SSID used to determine the final antenna position.

The selection criterion can be all RF signal targets, all unsecured RF signal targets, all secured RF signal targets, or other suitable criterion for locating a desired type or individual Wi-Fi source.

The disclosure also includes a self-aiming directional Wi-Fi antenna system. The system includes a directional Wi-Fi antenna, a motor coupled to the directional Wi-Fi antenna such that the motor can rotate the directional Wi-Fi antenna about one axis, and a motion controller electronically coupled to the motor. The motion controller can include a processor, a memory and an RF detector. Software code is stored in the memory and executable by the processor to actuate the motor to rotate the directional Wi-Fi antenna, detect RF signal targets automatically while the directional Wi-Fi antenna is rotating, determine an SSID automatically for each RF signal target while the directional Wi-Fi antenna is rotating, store in memory an antenna position data corresponding to each of the SSIDs that satisfy a selection criterion, and rotate the directional Wi-Fi antenna to a final position corresponding to the antenna position data for one of the SSIDs stored in memory.

The final position can correspond to an RF target that is unsecured and that possesses a highest RF energy value for all the SSIDs stored in memory.

The directional Wi-Fi antenna can be fully enclosed within an enclosure. The enclosure can be disposed atop a riser. The enclosure can be rotatable with respect to the riser.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
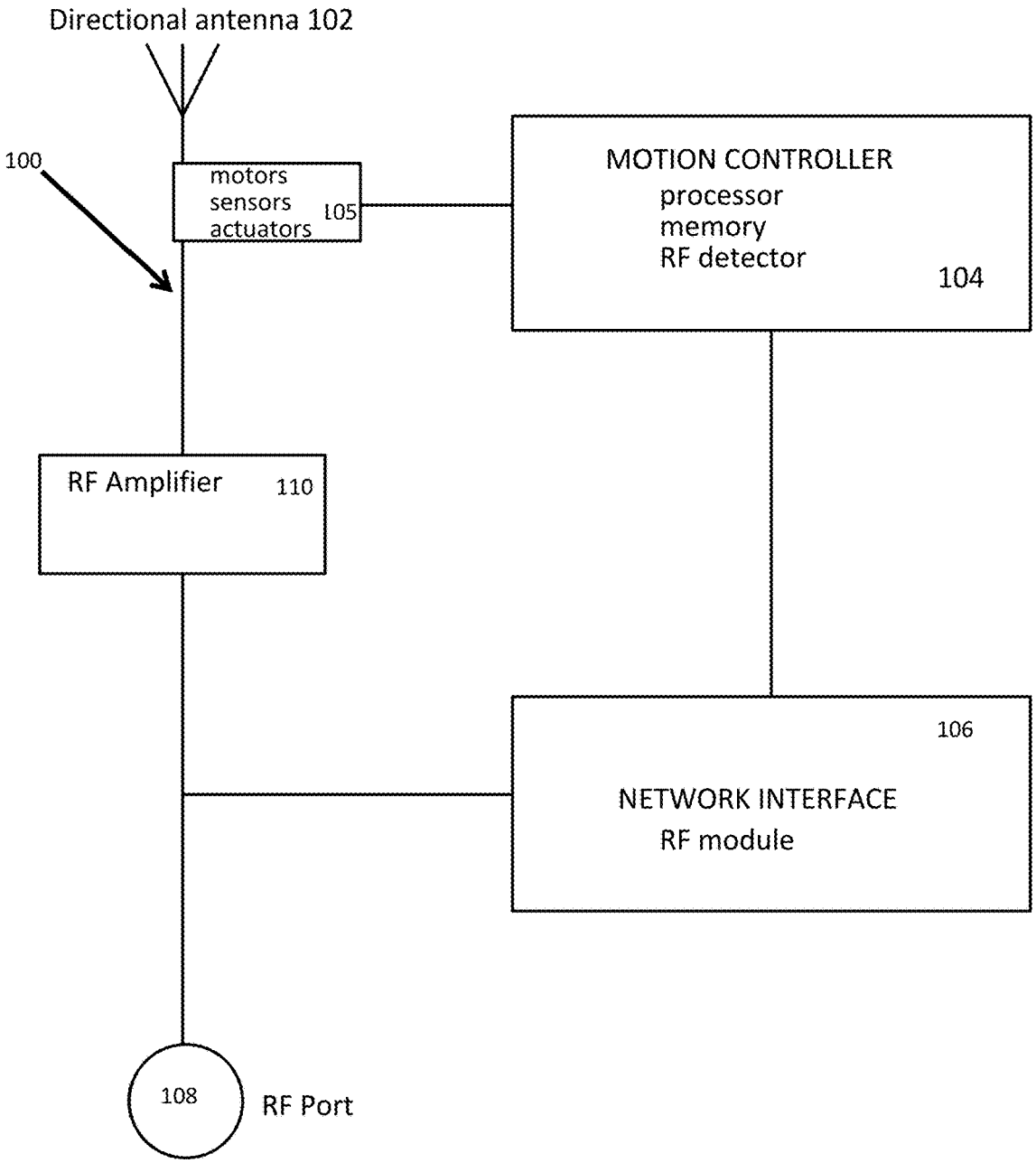
FIG. 1 is a block diagram according to certain example embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention. The various features or aspects discussed herein can also be combined in additional combinations and embodiments, whether or not explicitly discussed herein, without departing from the scope of the invention.

The antenna system disclosed herein provides convenient improvement of the reception signal for wireless devices by including a far higher gain antenna than that of an omnidirectional antenna (such as may be included in a user's computing device, or externally thereto) while making the aiming process painless for the user. It is also possible to place the antenna system in a location with a better line-of-sight to a given Wi-Fi access point's antenna, such as on a rooftop of a vehicle or building, on a pole, etc.

Referring first to the diagram of FIG. 1, the antenna system 100 includes an antenna 102 appropriate in size and shape to be compatible with the frequency or frequencies of the Wi-Fi signal that the user wishes to improve reception with (this may be any variety including multiples of 2.4 GHz, 5 GHz, or other frequencies regulatory bodies may choose to assign to IEEE802.11 "Wi-Fi" in the future). Other types of antennas with directional receiving characteristics (i.e. where gain is not the same in all directions) can also be employed.

The antenna system 100 further includes a motion control subsystem comprising one or more sensors and motors or actuators 105, and a motion controller 104. An RF detector is coupled to the motion controller, or integrated with the motion controller. The motors can be configured to move the antenna in 1, 2 or 3 axes, for example. The RF detector discerns the presence and magnitude of signal strength for the Wi-Fi frequency or frequencies of interest.

The controller 104 of the motion control subsystem comprises a microprocessor (processor) and non-transitory memory. Software code is stored in the non-transitory memory and executed by the processor such that the controller selectively operates the motors or actuators of the antenna system to aim the antenna based upon information from the RF detector and the RF Wi-Fi network chipset that decodes the network identification data transmitted from that access point.

A network interface 106 is coupled to the motion controller subsystem to decode the Wi-Fi network identification for evaluation by the controller 104. The network interface 106 includes a chipset (or multiple chipsets) containing an RF module that is compatible with Wi-Fi communications.

The output of the antenna system 100 is provided at an RF port 108 that can be connected to a variety of devices, including a signal "booster" amplification device 110, a wireless router providing network connections to local devices, a Wi-Fi card installed in a computer, a Wi-Fi chipset in a mobile computing device, or any other device capable of connecting to a Wi-Fi network.

An amplifier can also be included internal to the antenna system 100 so that the output from the system is amplified without any need for a separate amplifier device.

Power for the motion control subsystem components can be provided by a variety of available sources, including solar cells coupled to the antenna, by a power input line, onboard batteries, generator, or other type of fuel cell. The power input line can be public grid power, or power supplied from any external source such as a vehicle.

Figure 2:
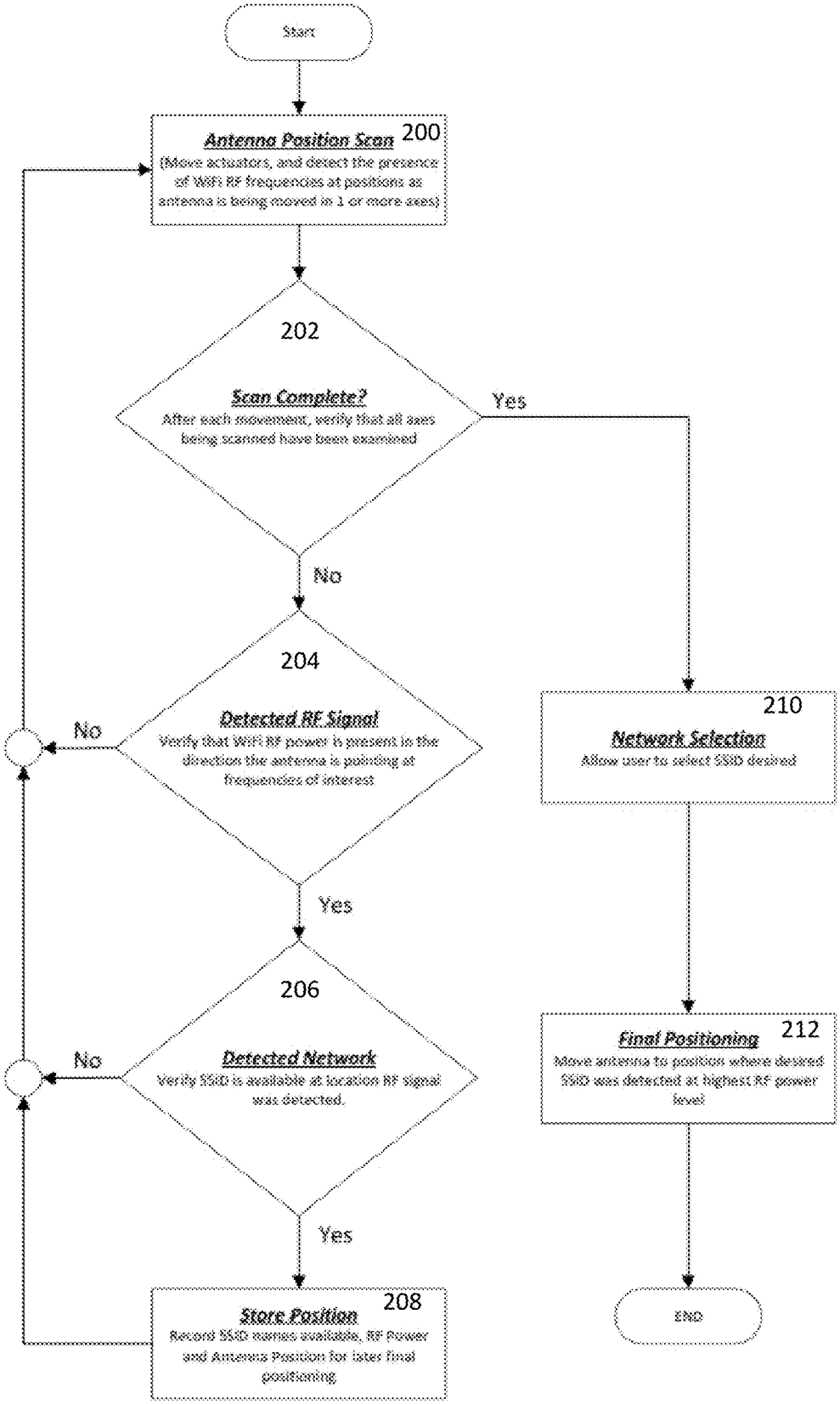
FIG. 2 is an algorithm flowchart for positioning a Wi-Fi antenna according to certain example embodiments.

FIG. 2 is an operational algorithm for aiming the antenna. Software code is stored in memory to control the operation according to the indicated algorithm. Data, such as antenna position can be stored in re-writable memory of the motion controller or in a separate non-transitory memory.

The antenna system performs a position scan 200 where the antenna is moved while the Wi-Fi RF signals are detected. This scanning and detection continues until completed 202. The completion query 202 can depend on the embodiment. For example, in one mode/embodiment, the antenna scans the full cycle of all movable axes. During the scan process, each detected Wi-Fi signal target 204 is decoded to obtain its SSID 206. For each SSID detected, the corresponding RF Power measurement and antenna position/orientation data are stored in memory 208.

Next, the antenna system determines a network selection 210. In one mode or embodiment, the user is presented with a list of possible SSIDs and the user then chooses a particular SSID. In another embodiment or more, the antenna control system automatically decides which of the SSIDs to select. In the auto-select embodiments/modes, the controller can filter the SSIDs according to selection parameters, such as the strongest open or unsecured Wi-Fi signal. In another example, the controller can choose a class of SSIDs, such as the strongest Wi-Fi signal for an SSID containing the character string "KOA" since all KOA campground Wi-Fi SSIDs would contain the string KOA, or all SSIDs containing the character string "ATT". Other selection parameters can be utilized as well.

Once the SSID is selected 210, then the final positioning of the antenna 212 is performed. In this step, the controller actuates the motor(s) to move the antenna according to the stored position data so that the antenna points at the selected Wi-Fi source.

The storing of antenna positions in memory can also be beneficial because a repeated aiming at a source determined to be non-compatible can be avoided by skipping the stored "bad" positions on subsequent searches.

Additional data can also be stored in memory, including RF power and the antenna positions for networks detected at stored previous antenna positions, both conforming to the Wi-Fi network (i.e., "good") and non-conforming to the user's network (i.e., "bad").

Stored RF power levels can be used to establish a dynamic floor for finding RF hotspots of interest as part of a searching algorithm.

Stored "good" locations can aid in re-locating a previous target location of interest. For example, in one embodiment or operating mode, upon powering ON (or the user initiating a search), the antenna can attempt to lock onto the most recently selected SSID using the stored antenna position data as a primary selection criterion. Then, if the primary SSID target cannot be located, a secondary selection criterion can be employed to find a new target Wi-Fi source.

The automated nature of various embodiments provides for a very user-friendly system. For example, the antenna system can be configured as a "one-button" operating mode. In such mode or embodiment, upon powering on by the user via the single power button, the antenna can automatically begin searching for a suitable Wi-Fi source according to any of the selection criterion discussed herein. Primary, secondary and further fallback selection criterion can be followed as discussed herein. The result is that the user need not interact further with the antenna system beyond powering the system ON.

The ON button can also be multi-functional. For example, the user could hold the ON button for a few seconds to initiate a new search routine. A brief press of the ON button would turn the system OFF.

A user interactive panel or button plate can be provided remote from the antenna since the antenna is typically to be mounted on the roof of a vehicle. The remote button or panel can be mounted in a convenient place for the user, such as on an interior surface of the vehicle. Alternatively, the user can operate a hand-held remote control for remotely interacting with the antenna. The remote control can be a small enclosure with one or more buttons that wirelessly communicates with the antenna control system. The motion controller includes a suitable receiving component for the wireless transmission. The user can also remotely interact with the antenna via a user computing device as will be described herein.

A feature and benefit of the disclosed system and methods includes the ability to discern Wi-Fi signals of interest from the surrounding RF "noise" that is present commonly in the same frequency spectrum. Wi-Fi operates in the unlicensed Industrial, Scientific and Medical ("ISM") band where many different and incompatible radio communications must coexist. This includes devices like cordless phones, Bluetooth, ANT+, microwave ovens, and other similarly common items.

The invention in certain embodiments includes the feature of the ability to receive and understand Wi-Fi signals by including a Wi-Fi radio and protocol-aware electronics directly onboard. This allows the antenna pointing system to discern which Wi-Fi signals are available in a given direction the antenna is pointing, allowing the control algorithm to read network Service Set Identifier ("SSID") names in a specific direction, and in response, move the antenna into the best position to communicate on the network the user desires to connect to.

Since the antenna pointing system is aware not only of Wi-Fi generally, but additionally can find a specific-named SSID and associated encryption method used by that named SSID, it is not subject to accidentally locking on to a Bluetooth signal and pointing at its source instead of the Wi-Fi network the user really wishes to connect with. Also, the antenna system can perform a search for "open" types of networks or "secured" networks according to a user's preferences.

Another feature and advantage of the disclosed system and methods is the provision of an easy mechanism for the user to select which Wi-Fi network he/she may wish to communicate with. The antenna system can be instructed to seek-out a specific SSID that the user wishes to define. The specific desired SSID can be input through an internal web page using a computer or other device connected to the antenna system through wired or wireless means.

The motion controller subsystem can also include a wireless communications component (e.g. Bluetooth, Wi-Fi, ZigBee, other) to enable the antenna system to communicate with the user's computing device, e.g., smartphone, computer, tablet, vehicle-mounted controller, smart watch, smart glasses, etc. This allows the user to control the antenna with a software application ("app") stored on the user's computing device.

The antenna system can also provide the user with feedback via the app such as connection status, operating power level (e.g. battery power), and a visual signal strength display via the computing device's display. Wired connections between the antenna system and the computing device can be provided in addition to, or in the alternative to, wireless connections.

Referring to FIGS. 3-6 an example of an app executing on a computing device will now be discussed. The particular example being discussed is an app on a smartphone, but the app can also be a web-based app or web-app and the smartphone can be any type of computing device.

Figure 3:
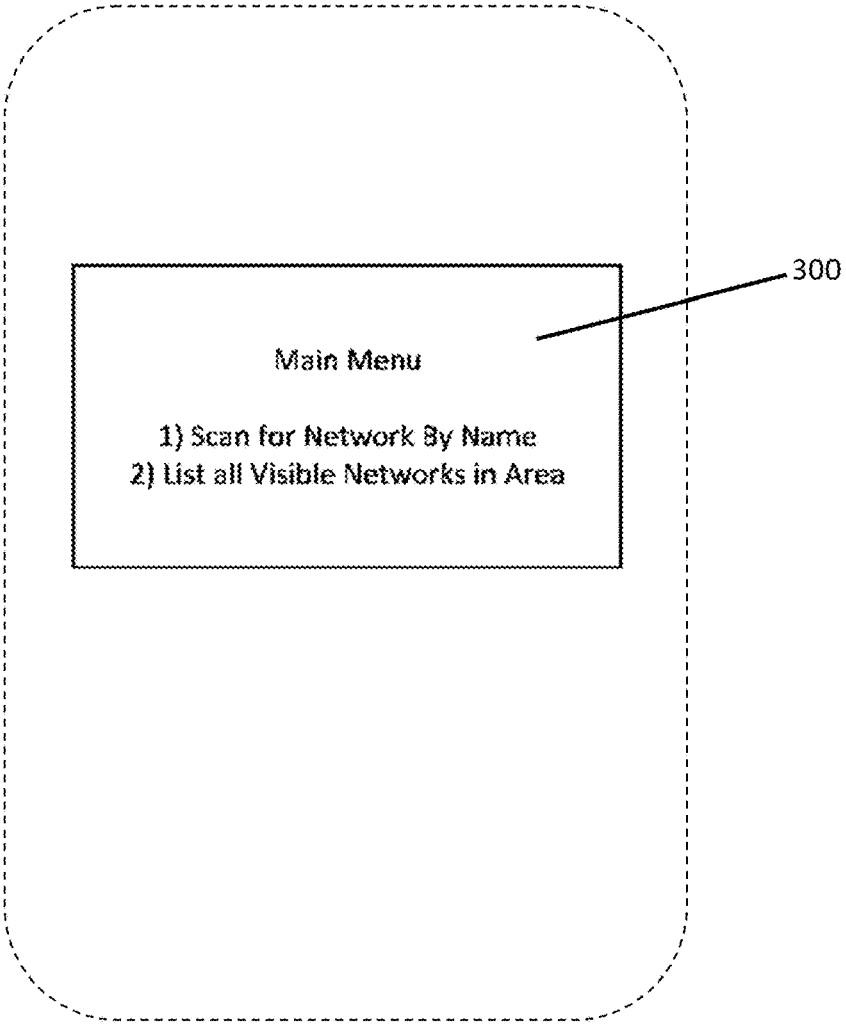
FIGS. 3-6 are user interface illustrations according to certain example embodiments.

Upon launching the app, and assuming that the smartphone is paired with the antenna system (via conventional means), the user is presented in FIG. 3 with a screen asking whether they wish to command the antenna system to either (1) search (scan) for a specific Wi-Fi network by SSID, or (2) perform a general scan for all available Wi-Fi networks that meet the controller's operating parameters. The user's selection mode choice is then relayed to the controller.

In another alternative, the user can be provided with a third option to find the strongest "open" or unsecured Wi-Fi signal.

The controller of the antenna system can also simply find the strongest member of a set, class or family of pre-programmed SSIDs. In such embodiment, the antenna system would not need any input from the user for routine operation. The pre-programming can be performed as part of an initial set-up routine. One example class is all SSIDs that contain the character string "KOA". A class can also include disjunctive options, such as all SSIDs that contain either "KOA" or "ATT".

If the antenna located multiple sources of Wi-Fi employing the same SSID, then the best of the possible sources will be chosen (e.g. highest RF power and/or lowest BER).

Figure 4:
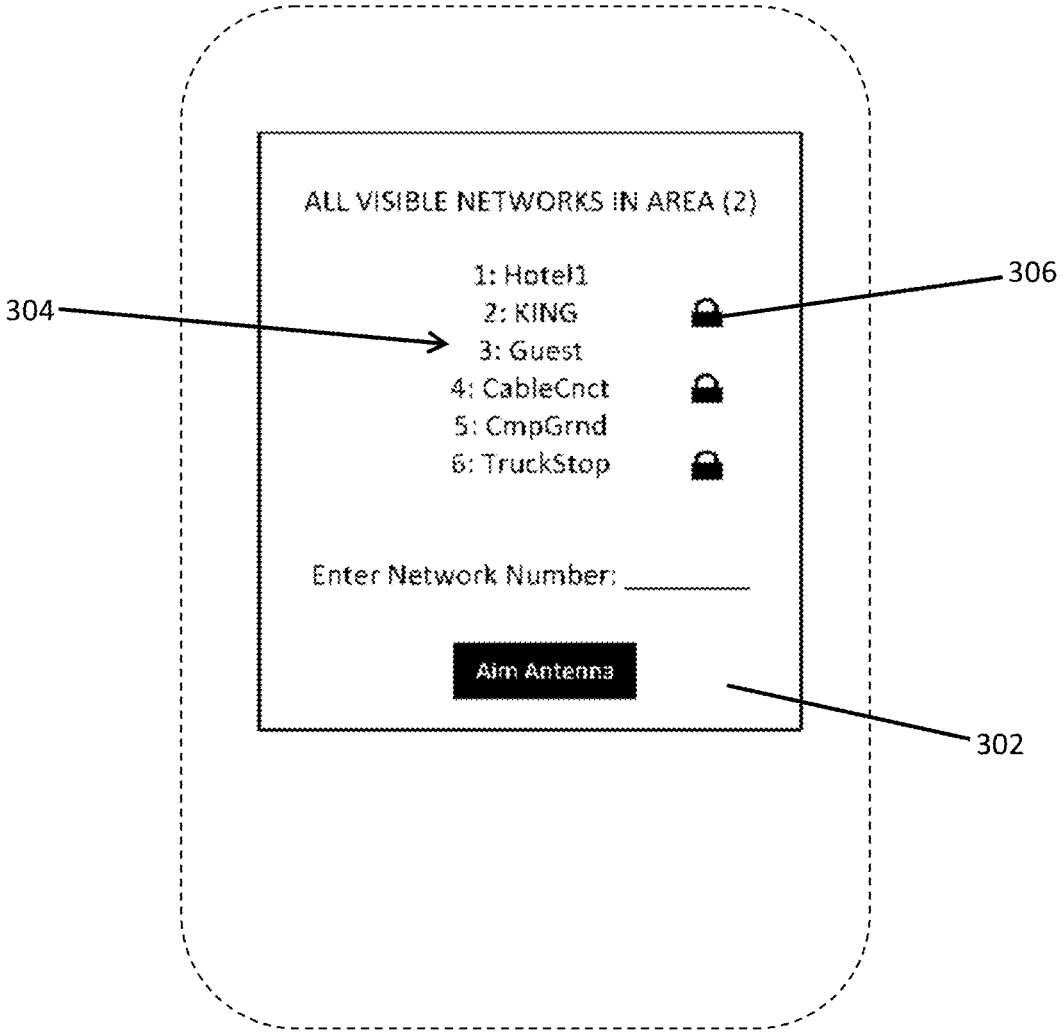

FIG. 4 shows the user screen reporting results of a scan operation 302 following the user's choice to scan for all available Wi-Fi networks that meet the controller's operating parameters. The networks 304 can be listed in any order. However, in certain embodiments, the networks can be listed in order of strength, or by alpha, or by security status.

The secured networks in FIG. 4 are noted with a lock symbol 306. The open or unsecured networks do not have a lock. An alternative open symbol (e.g. an open lock) can also be noted next to the open networks.

The list provided to the user can be just those networks that meet a particular selection criterion, such as having an RF power above a floor (or dynamic floor) value.

The user next selects the network from the list that they want to connect to and that choice is relayed to the controller. In the example in FIG. 4, the user inputs the corresponding network list number, however, the user could alternatively tap on the desired network to make a selection if their computing device supports such operation. The controller then moves the antenna to the position stored in memory corresponding to the chosen network.

Figure 5:
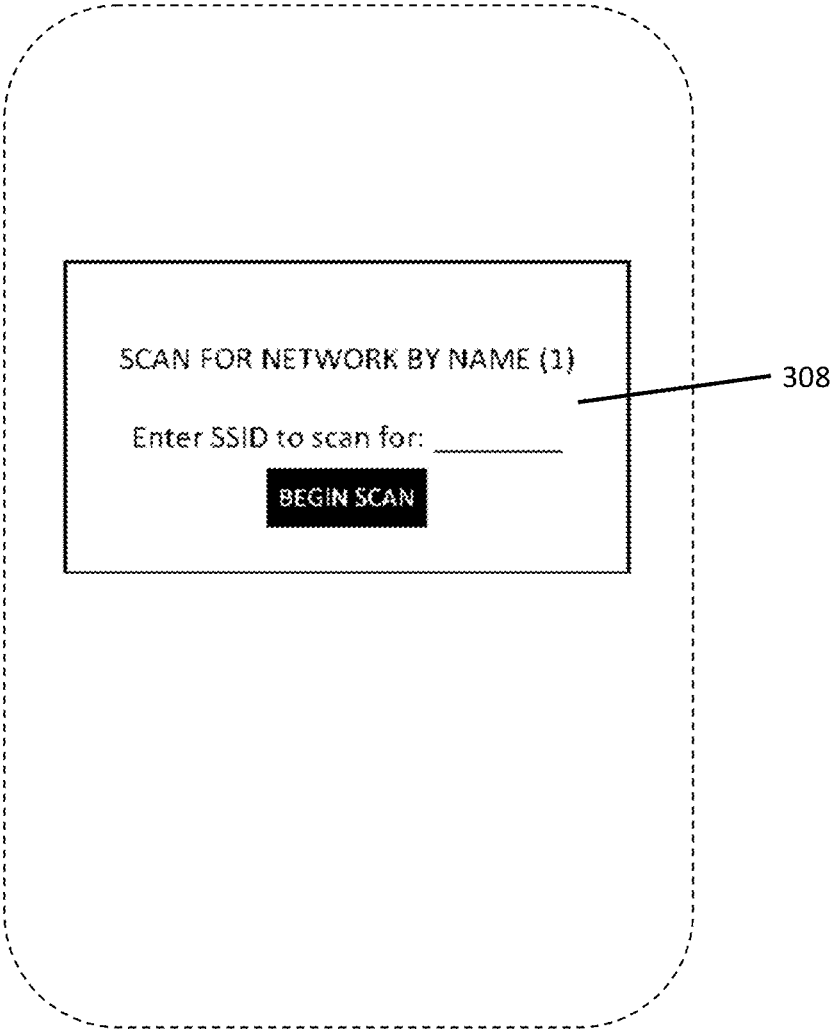

FIG. 5 illustrates the screen 308 presented to the user if the selection in FIG. 3 was to scan for a specific SSID (or partial SSID). The user is thus prompted to input a specific SSID. The SSID input can either be specific, or it can contain a partial ID. For example, the user could enter the letters KOA because they know that all KOA campgrounds have the letters KOA in their SSID.

The user's SSID input is then relayed to the controller. The controller then scans for the strongest Wi-Fi signal matching the selected SSID or partial SSID.

Figure 6:
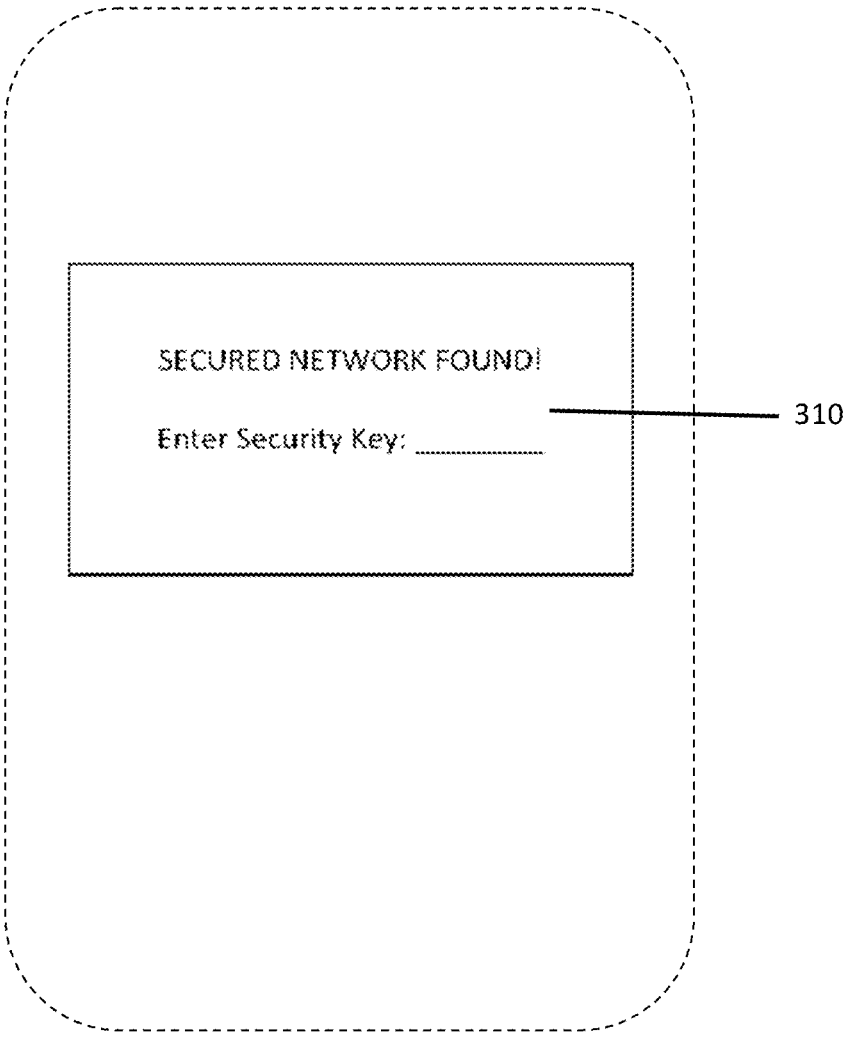
Figure 7:
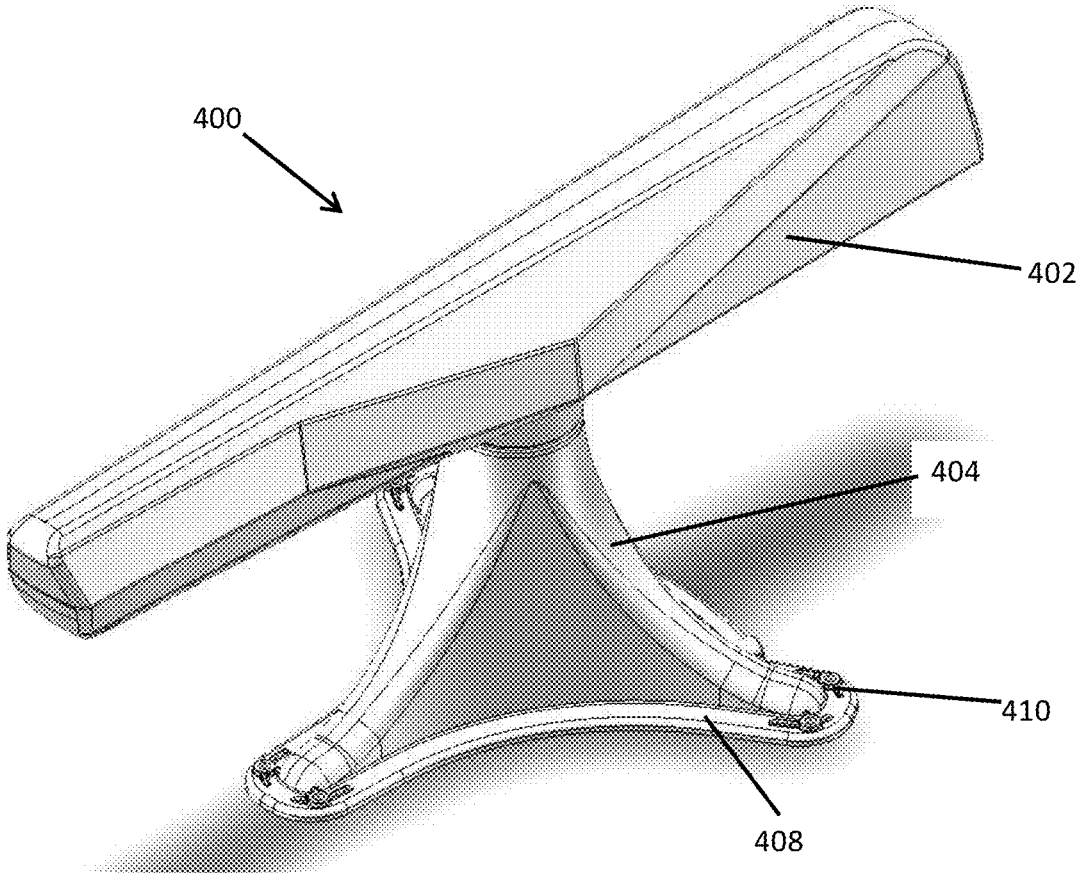
FIG. 7 is a perspective view of a self-pointing Wi-Fi antenna according to certain example embodiments.
Figure 8:
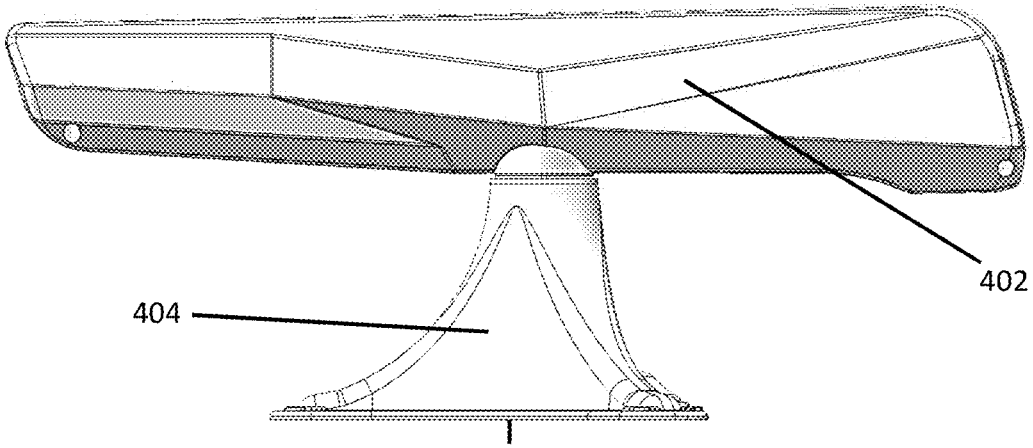
FIG. 8 is a side view of a self-pointing Wi-Fi antenna according to certain example embodiments.
Figure 9:
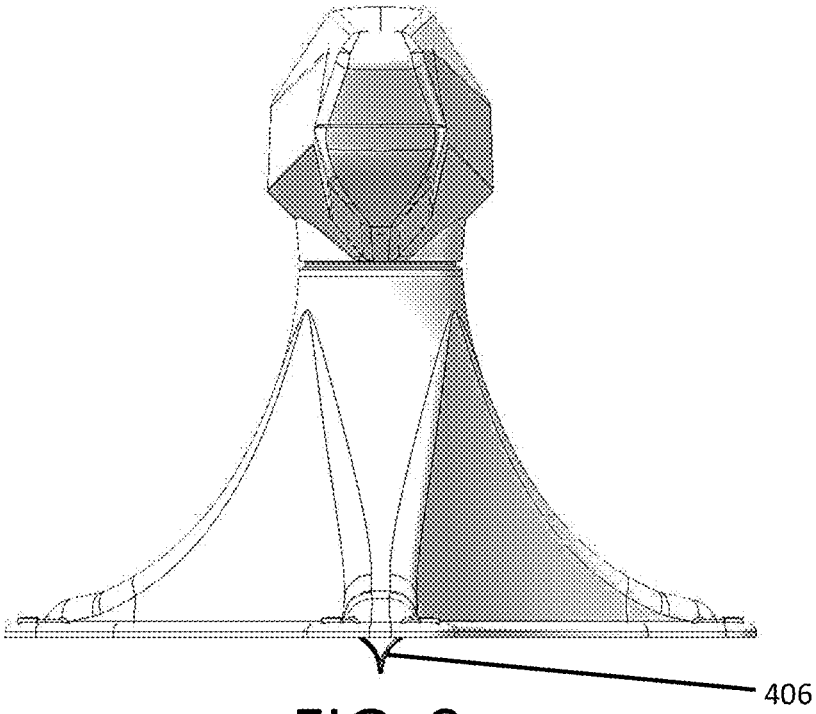
FIG. 9 is a front view of a self-pointing Wi-Fi antenna according to certain example embodiments.
Figure 10:
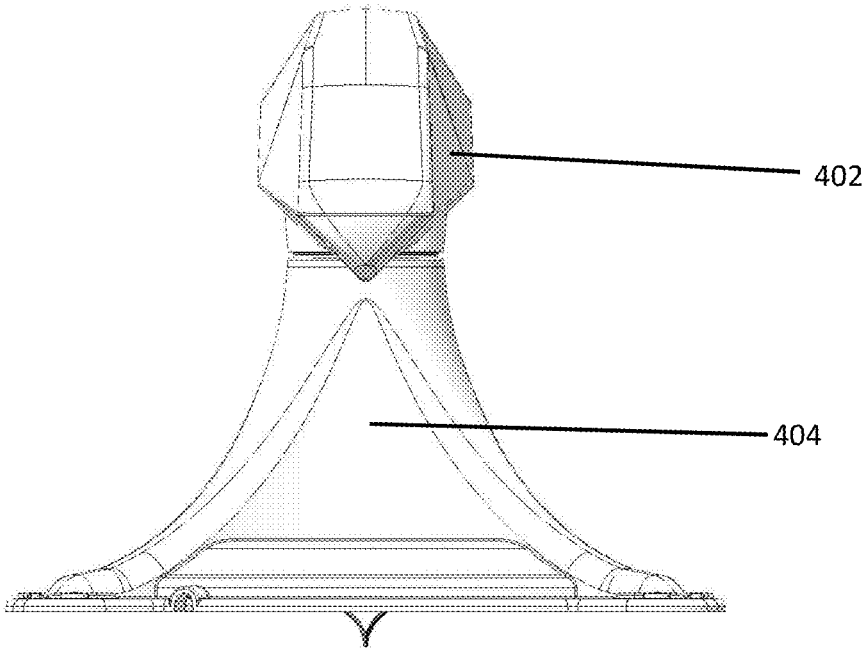
FIG. 10 is a rear view of a self-pointing Wi-Fi antenna according to certain example embodiments.
Figure 11:
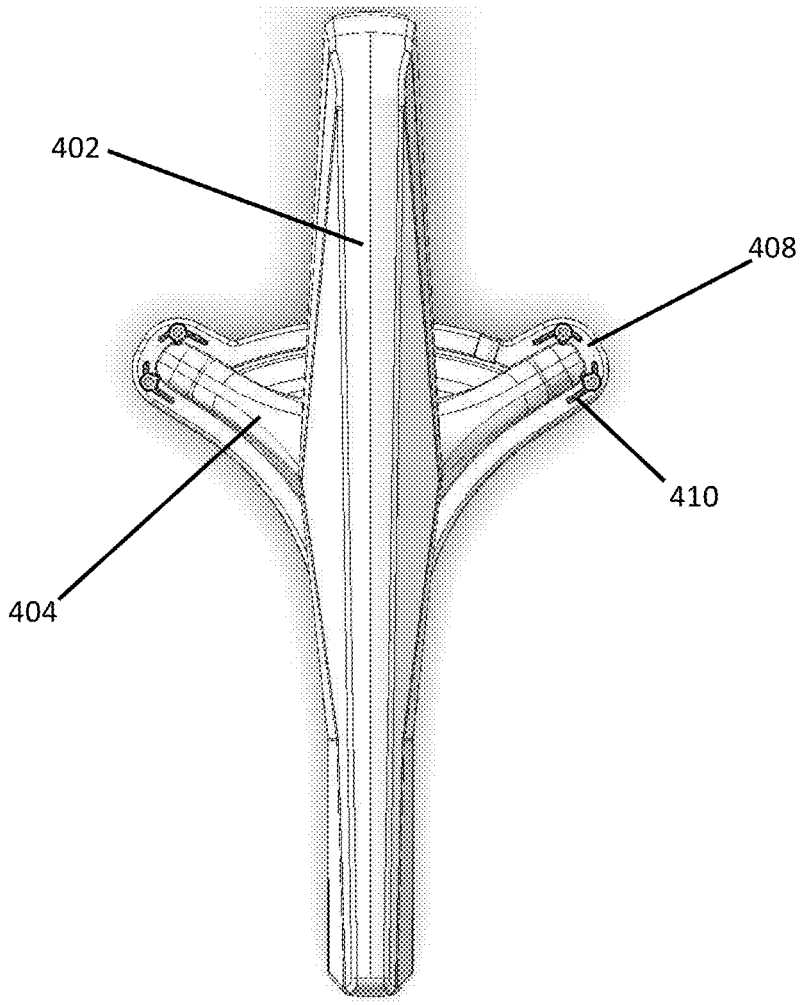
FIG. 11 is a top view of a self-pointing Wi-Fi antenna according to certain example embodiments.

FIG. 6 shows the screen presented to the user to input a security key 310 if the chosen Wi-Fi network requires a security key.

In additional embodiments, the antenna system can store in memory the names of SSIDs that have been preauthorized (either by the user, or by a manufacturer, Wi-Fi service provider, or similar) and can point at them automatically with no direct intervention from the user. The corresponding security keys can also be stored when successfully entered by the user so that the user need not re-enter the key when returning to that Wi-Fi network.

Referring now to FIGS. 7-11, an example embodiment of a housing 400 for the present antenna system is shown. The housing 400 generally comprises an antenna enclosure 402 rotatably mounted atop a riser 404. The enclosure 402 is formed of a rigid plastic material that easily permits the passage of RF energy. The riser 404 can be formed of a plastic material that can be the same as or different than the enclosure 402.

The directional RF energy reception components of the antenna can be located inside of the antenna enclosure 402. The motor for rotating the antenna in azimuth, the motion controller, RF detector and amplifier can all be housed in the riser. Other component arrangements can also be provided.

A rotary coupling is used to pass the signals from the components inside of the antenna enclosure 402 to the components inside of the riser 404.

Conduits for power and/or signals can be passed downward from the riser to penetrate through the roof of the vehicle, or such conduits may pass out of the riser via a port or multiple ports defined in the riser's outer surface. A single two-way conduit can be provided that can both supply power to the antenna components while passing signals from the antenna to external components such as a Wi-Fi router.

In one embodiment, the antenna is powered by onboard batteries that are recharged via a solar cell array disposed on the vehicle. The solar charge controller can be included with the housing, or the antenna battery can be coupled to the vehicle's onboard charging systems. The antenna can be configured for DC power, AC power or can automatically switch between AC and DC power depending on whichever is available from the vehicle to which the antenna is mounted.

The bottom portion of the riser defines a base that includes one or more flanges 408 and/or apertures 410 to facilitate placement of fasteners to secure the antenna to the roof of the vehicle or to any other mounting surface.

The dimensions, shape and proportions of the antenna enclosure 402 and of the riser 404 can be varied to accommodate various antenna component configurations and sizes, to minimize wind resistance, as well as to convey a particular aesthetic, if desired. The riser 404 height can be selected to stay within maximum clearance above the vehicle to which it is mounted. However, the height can also be selected to avoid RF energy being blocked by other components on the vehicle roof, such as air conditioning units.

The enclosure and riser can be integrated into a single enclosure. The integrated enclosure can be mounted on a rotating/articulating platform. The enclosure can also be sized and shaped sufficiently to allow the antenna to move inside of the static enclosure (whether separated or integrated with the riser).

The antenna can also be motorized to change its elevation or pitch angle. In further embodiments, the antenna can also be rotated to change its skew angle.

In alternative embodiments, some portions or all the antenna components can be external to an enclosure, or not enclosed at all. Some of the electronic components can be housed separate from the antenna housing in still further embodiments, such as, for example, disposing the controller in a remotely-located control housing, or integrating the controller components into another electronic device.

In certain embodiments, the antenna motion controller can execute "park" and "deploy" movements of the antenna by selectively actuating one or more motors. The "park" command can move the antenna to a stowed position for vehicle movement or storage when not in use. The "deploy" command moves the antenna from its parked position to the active ready for use position. The commands can be initiated by the user via the app, or can be performed automatically upon a power-up/power-down condition. The movement between the parked and deployed positions can include one or more of a folding, vertically extending and pivoting movement of portions of the antenna device.

The user can also be provided with the option for "manual" actuation of the antenna motors. In such embodiment, the user can manually push actuation buttons via the app or via buttons on a component of the antenna system, or via a dedicated remote control device. In this embodiment or operating mode, the user may wish to manually alter one or more of the antenna's axes for whatever reason. A semi-automatic operation mode can also be provided where the controller automatically alters at least one of the antenna axes and the user manually alters at least one of the antenna axes.

Some or all the features of the various embodiments or operating modes disclosed herein can be provided in a given antenna system. Where there are multiple different operating modes the user can select amongst them by interacting with the antenna unit in at least one of the ways discussed herein.

While the invention has been described in connection with what is presently considered to be the most practical and preferred example embodiments, it will be apparent to those of ordinary skill in the art that the invention is not to be limited to the disclosed example embodiments. It will be clear to those of ordinary skill in the art that many modifications and equivalent arrangements can be made thereof without departing from the spirit and scope of the present disclosure, such scope to be accorded the broadest interpretation of the appended claims so as to encompass all equivalent structures and products.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A method of automatically aiming a directional Wi-Fi antenna system, comprising:

actuating a motor to move a directional Wi-Fi antenna about at least one axis;

detecting radio frequency (RF) signal targets automatically while the directional Wi-Fi antenna is moving;

determining a Service Set Identifier (SSID) automatically for each RF signal target broadcasting an SSID while the directional Wi-Fi antenna is moving;

storing automatically in memory an antenna position data and the SSID corresponding to each RF signal target broadcasting an SSID while the directional Wi-Fi antenna is moving;

receiving an SSID selection from a user; and moving the directional Wi-Fi antenna to a final position corresponding to the antenna position data for one of the SSIDs stored in memory and corresponding to the SSID selection from the user.

2. The method of claim 1, further comprising determining a dynamic average RF energy value by averaging an RF value for a plurality of detected RF signal targets.

3. The method of claim 2, further comprising displaying on a screen of a user computing device all SSIDs that have RF energy values greater than the dynamic average energy value.

4. The method of claim 1, further comprising storing an RF energy value in memory corresponding to each RF signal target while the directional Wi-Fi antenna is moving.

5. The method of claim 4, wherein the step of moving the directional Wi-Fi antenna to the final position includes moving the directional Wi-Fi antenna to the final position corresponding to the antenna position data for the SSID stored in memory with the highest RF energy value that corresponds to the SSID selection from the user.

6. The method of claim 4, wherein the SSID selection from the user is a partial SSID character string.

7. The method of claim 1, wherein the step of actuating the motor is performed automatically upon the Wi-Fi antenna system being powered ON.

8. The method of claim 1, wherein the step of actuating the motor is performed automatically upon a user inputting a search command remotely.

9. The method of claim 1, further comprising syncing the directional Wi-Fi antenna system to a user's computing device.

10. The method of claim 1, wherein the SSID selection corresponds to unsecured RF signal targets.

11. The method of claim 1, wherein the SSID selection corresponds to secured RF signal targets.

12. The method of claim 1, further comprising displaying on a screen of a computing device a list of all SSIDs corresponding to RF signal targets that have been stored in memory.

13. The method of claim 12, further comprising the user selecting via the computing device one SSID from the list of all SSIDs displayed on the screen.

14. A self-aiming directional Wi-Fi antenna system, comprising:

a directional Wi-Fi antenna;

a motor coupled to the directional Wi-Fi antenna such that the motor can rotate the directional Wi-Fi antenna about one axis; and a motion controller electronically coupled to the motor, wherein the motion controller comprises a processor, a memory and an RF detector, wherein a software code is stored in the memory and executable by the processor to:

actuate the motor to rotate the directional Wi-Fi antenna;

detect RF signal targets broadcasting an SSID automatically while the directional Wi-Fi antenna is rotating;

determine an SSID automatically for each such RF signal target while the directional Wi-Fi antenna is rotating;

store in memory an antenna position data and the SSID corresponding to each of the detected RF signal targets that are broadcasting an SSID;

receive an SSID selection from a user; and rotate the directional Wi-Fi antenna to a final position corresponding to the antenna position data for the SSID selection from the user that corresponds to one of the SSIDs stored in memory.

15. The automated directional Wi-Fi antenna system of claim 14, wherein the directional Wi-Fi antenna is fully enclosed within an enclosure.

16. The automated directional Wi-Fi antenna system of claim 15, wherein the enclosure is disposed atop a riser.

17. The automated directional Wi-Fi antenna system of claim 16, wherein the enclosure is rotatable with respect to the riser.

18. The automated directional Wi-Fi antenna system of claim 14, wherein the final position corresponds to an RF target that is unsecured and that possesses a highest RF energy value for the SSID selected by the user.

19. A self-aiming directional Wi-Fi antenna system, comprising:

a directional Wi-Fi antenna;

a motor coupled to the directional Wi-Fi antenna to rotate the directional Wi-Fi antenna about an axis; and a motion controller electronically coupled to the motor, wherein the motion controller comprises a processor, a memory and an RF detector, wherein a software code is stored in the memory and executable by the processor to:

actuate the motor to rotate the directional Wi-Fi antenna;

detect automatically RF signal targets broadcasting an SSID;

determine automatically an SSID for each such RF signal target;

store in the memory an antenna position data and for each determined SSID;

rotate the directional Wi-Fi antenna to a final position corresponding to the antenna position data for an SSID selection from the user that corresponds to one of the SSIDs stored in memory.

20. The system of claim 19, wherein the processor is further configured by the software code to select the final position corresponding to a one of the detected RF signal targets that possesses a highest RF energy value for the SSID selected by the user.

* * * * *